United States Patent [19]

Lewis et al.

[11] 4,260,480

[45] Apr. 7, 1981

[54] MULTIPLE HYDROCYCLONE DEVICE

[75] Inventors: Kenneth D. Lewis, Wilton, Conn.; Andrew P. Charlton, Pleasant Valley, N.Y.; Per Nyrop, Norwalk; Tristan O. Merediz, Fairfield, both of Conn.

[73] Assignee: Dorr-Oliver Incorporated, Stamford, Conn.

[21] Appl. No.: 934,317

[22] Filed: Aug. 16, 1978

[51] Int. Cl.[3] ..... B04C 5/28

[52] U.S. Cl. ..... 209/211; 210/512.2; 55/349

[58] Field of Search ..... 209/211, 144; 210/512 M; 55/349

[56] References Cited

U.S. PATENT DOCUMENTS

| | | | |
|---|---|---|---|
| Re. 25,099 | 12/1961 | Hoffmann | 209/211 X |
| 1,011,594 | 12/1911 | Dunham | 248/509 |
| 2,671,560 | 3/1954 | Fontein et al. | 209/211 |
| 2,915,991 | 12/1959 | Koth et al. | 211/49 R X |
| 3,335,860 | 8/1967 | Baxter | 209/211 |
| 3,559,811 | 2/1971 | Dahlberg | 209/211 X |
| 4,146,469 | 3/1979 | Kaiser et al. | 209/211 |
| 4,189,377 | 2/1980 | Dahlberg et al. | 209/211 |
| 4,190,523 | 2/1980 | Niemeijer | 209/211 |

*Primary Examiner*—Ralph J. Hill

*Attorney, Agent, or Firm*—Burtsell J. Kearns; Harold M. Snyder

[57] ABSTRACT

A multiple hydrocyclone device wherein cyclone units are integrally formed in radial relationship in premolded discs which are mounted in stacked concentric and internested relationship one upon the other within a common housing. The hub portions of the discs provide a central chamber to receive the underflow fraction from the cyclones with the overflow discharged from openings in the periphery of the discs to an outer chamber. Sealing rings are arranged between the internested discs to maintain leak proof integrity of the stacked discs with spring urgent thrust plate means disposed at the top of the stack to permit movement or expansion of the discs in operation of the device without disturbing the sealed relationship.

13 Claims, 17 Drawing Figures

MULTIPLE HYDROCYCLONE DEVICE

BACKGROUND OF THE INVENTION

The present invention is directed to cyclone separator devices and more particularly to a multiple hydrocyclone arrangement to treat solids contained in liquid suspensions.

Hydrocyclones are well known and include generally cylindrical bodies having a cylindrical base portion merging into an elongated conical section. A discharge outlet is provided in the apex of the conical section and a vortex finder is located in an opening in the cylindrical base portion arranged adjacent to a tangentially disposed feed inlet formed in the base portion. In operation of the cyclone a solids containing liquid is fed under pressure to the cyclone through the tangential feed inlet whereby a rotation motion is imparted to the feed. As a result a separation of a heavier fraction of solids or underflow from a lighter or overflow fraction is effected. The overflow being discharged through the vortex finder and the underflow being discharged through the apex opening.

Multiple hydrocyclone arrangements using a plurality of such cyclones within a common housing are well known as evidenced by such prior U.S. patents as in U.S. Pat. Nos. Re. 25,099; 2,671,560; 3,261,467; 3,415,374 and 3,959,123 and provide a compact separation apparatus requiring greatly reduced operating space. These multiple cyclone units comprise a plurality of hydrocyclones grouped in clusters and arranged in horizontal layers within the housing. In certain of these devices such as for example those of the type disclosed in the mentioned U.S. Pat. Nos. 3,261,308 and 3,959,123, the cyclones of each layer are arranged in a radial or spoke-like fashion with the spaced discharge outlets of the cyclones opening to spaced underflow and overflow discharge chambers. In such known devices a large number of cyclones are arranged in a cylindrical housing which is comprised of three concentric chambers. The cyclones are mounted on and extend between the outermost and innermost chamber with the apex openings of all the cyclones arranged to discharge the underflow into the innermost chamber. The outermost chamber provides a discharge area for the overflow from the cyclones with the feed to the cyclones transmitted to an intermediate chamber located between the inner and outer chambers.

These multiple hydrocyclone arrangements are particularly adaptable to processes directed to the treatment of starch, paper pulp and mineral ore slurries and are used in the treatment of liquid suspensions for the purposes of thickening the suspension or for classifying the suspended solids into predetermined fractions. Problems are encountered however in replacing worn or defective cyclone bodies without unnecessarily prolonged shutdown procedures in operation of the entire device. In addition the known rigid housing structures in which the cyclones are mounted, involve relatively complex manufacturing procedures and necessitate individual mounting means for the individual hydrocyclones to support the same within the housing structure which results in increased manufacturing costs both in labor and parts. In addition known multiple cyclone arrangements do not allow for the ready addition of hydrocyclone clusters or for otherwise varying the size of the device in accordance with particular needs of the user.

It is an object of the present invention to provide a novel multiple cyclone device wherein the individual cyclone clusters are formed in premolded sectors.

Another object is to provide novel cyclone clusters including novel means for locating vortex finders in cyclone bodies formed therein.

Another object is to provide a novel arrangement of cyclone clusters formed in premolded discs wherein novel means are provided for maintaining the discs in nested and sealed relationship in a common housing.

Another object is to provide novel means for sealing the discharge and feed chambers one from the other to maintain leak proof integrity during operation of the device.

A further object is to provide a novel multiple cyclone assembly comprised of a minimum number of structural elements and having inherent modular capabilities allowing for the addition or deletion of individual cyclone clusters for varying the operational capacity of the assembly.

A still further object is to provide a multiple hydrocyclone apparatus of standardized parts for use in different operational sized equipment to reduce costs in manufacturing and assembly procedures.

SUMMARY OF THE INVENTION

The present invention contemplates a novel multiple hydrocyclone apparatus wherein the cyclone units are integrally formed in radial relationship in premolded discs. A plurality of such discs are mounted in stacked concentric relationship within a common housing with internesting means provided on the discs for arranging the discs in stacked but otherwise unattached relationship one upon the other. The nested hub portions of the discs form a central chamber for receiving the discharge, or underflow fraction, from the apex openings of the cyclones. Circular conduits are formed by the internested portions of the discs to seat sealing O-rings therein with the walls of the conduits effecting a radial force upon the O-rings to maintain leak proof integrity of the sealed chambers. Removable vortex finders are located in each cyclone body adjacent a feed inlet therein which receives the feed from a common internal feed chamber located intermediate the hub and outer rims of the stacked discs. The outer rims of the discs are spaced from the inner walls of the housing and provide therebetween a discharge chamber for the lighter fraction which is discharged through the vortex finders. Spring urged thrust plate means are seated on the top disc in the assembled stack and suitable O-rings are interposed between the stack and the thrust plate upon which it exerts an axial sealing force. The thrust plate holds the discs in vertical relationship but allows for movement or expansion of discs in operation of the device in accordance with predetermined feed pressure and thermal expansion factors without disturbing the sealed relationship of the mentioned chambers.

The above and other objects and advantages of the present invention will appear more fully hereinafter from a consideration of the detailed description which follows taken together with the accompanying drawings wherein two embodiments of the present invention are disclosed:

GENERAL DESCRIPTION OF THE INVENTION

Figure 1:
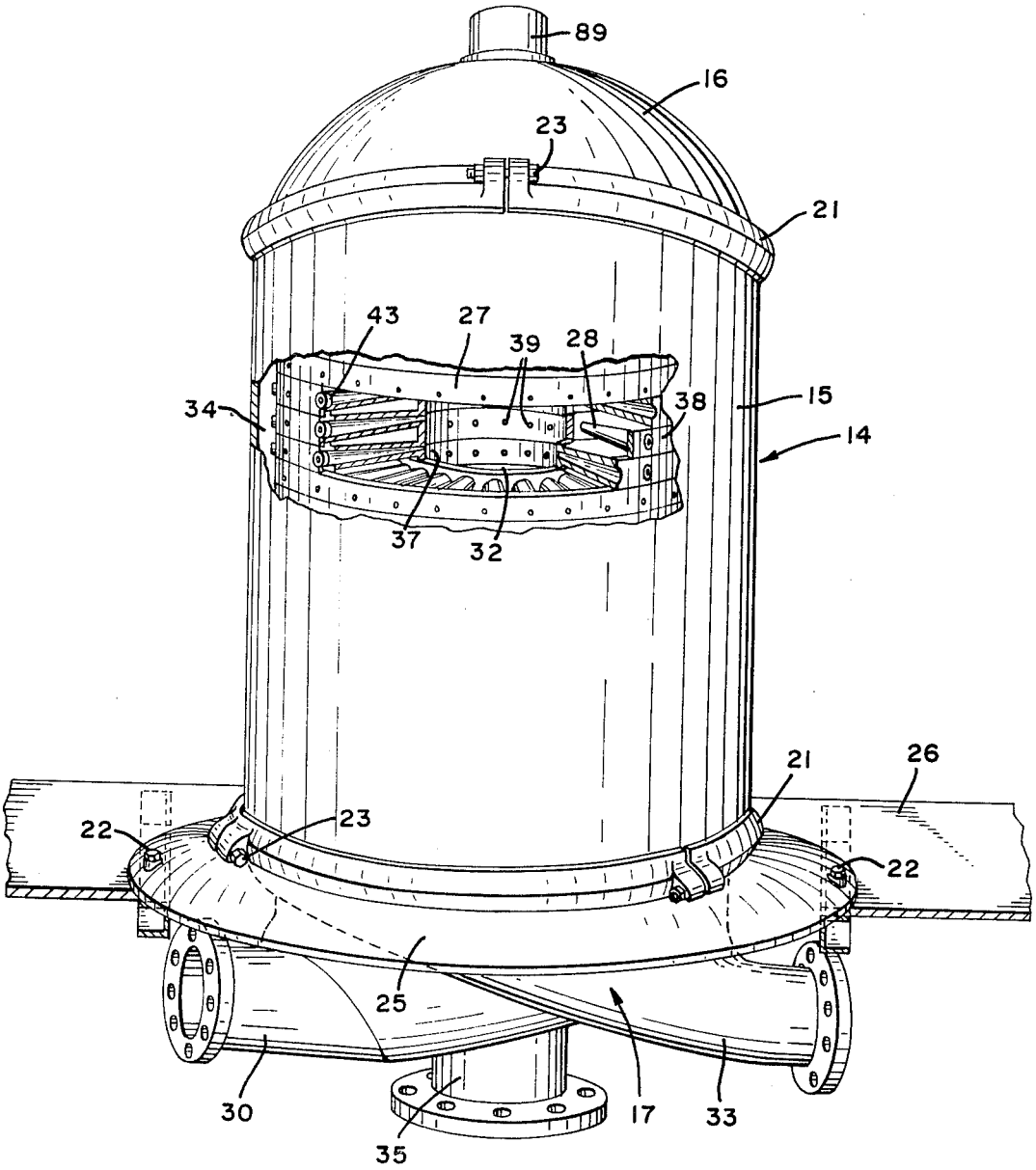
FIG. 1 is a perspective view of the multiple hydrocyclone assembly with portions of the outer housing and nested cyclone discs broken away to show portions of the interior structure thereof.
Figure 2:
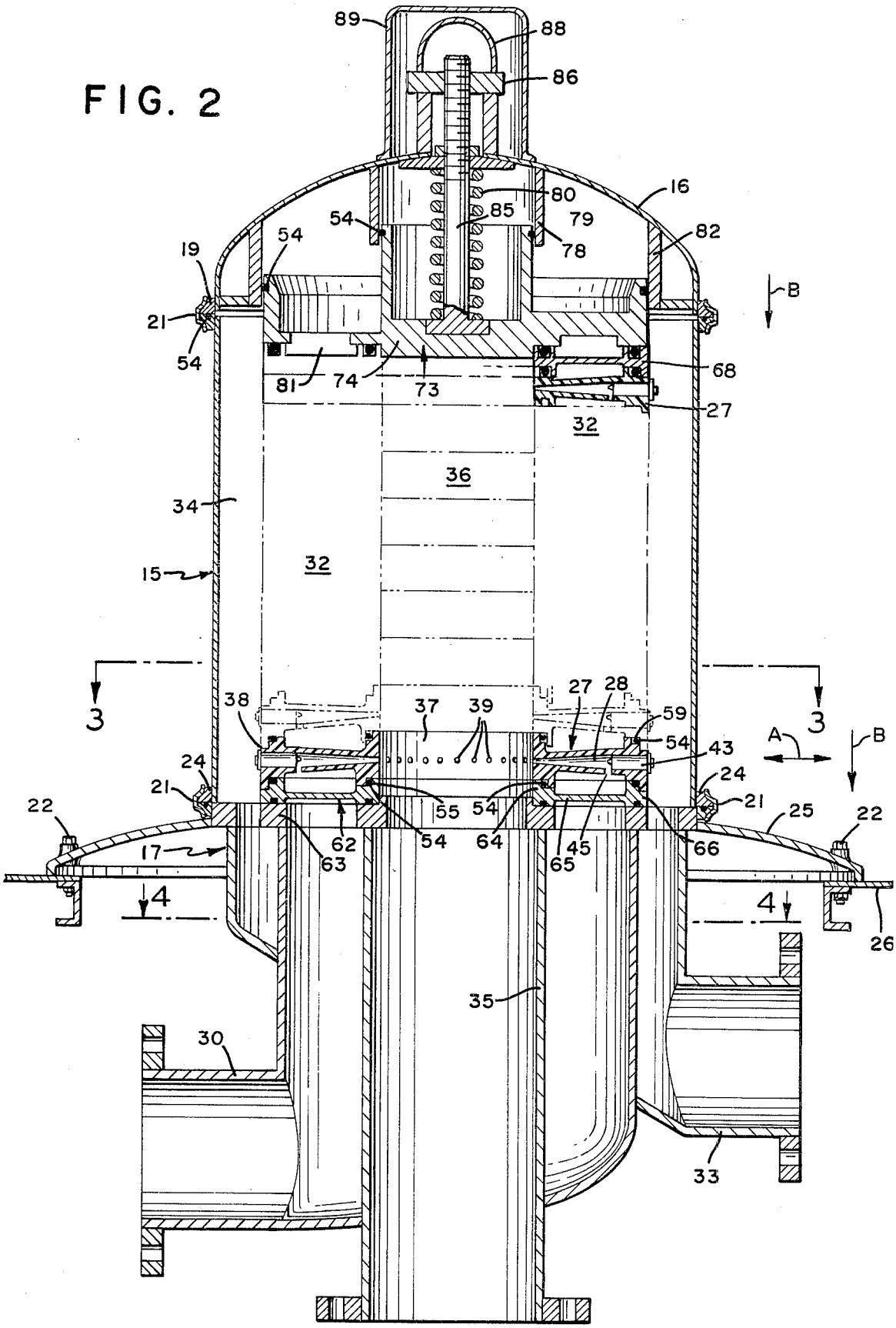
FIG. 2 is a cross-sectional elevational view of the device of FIG. 1.
Figure 3:
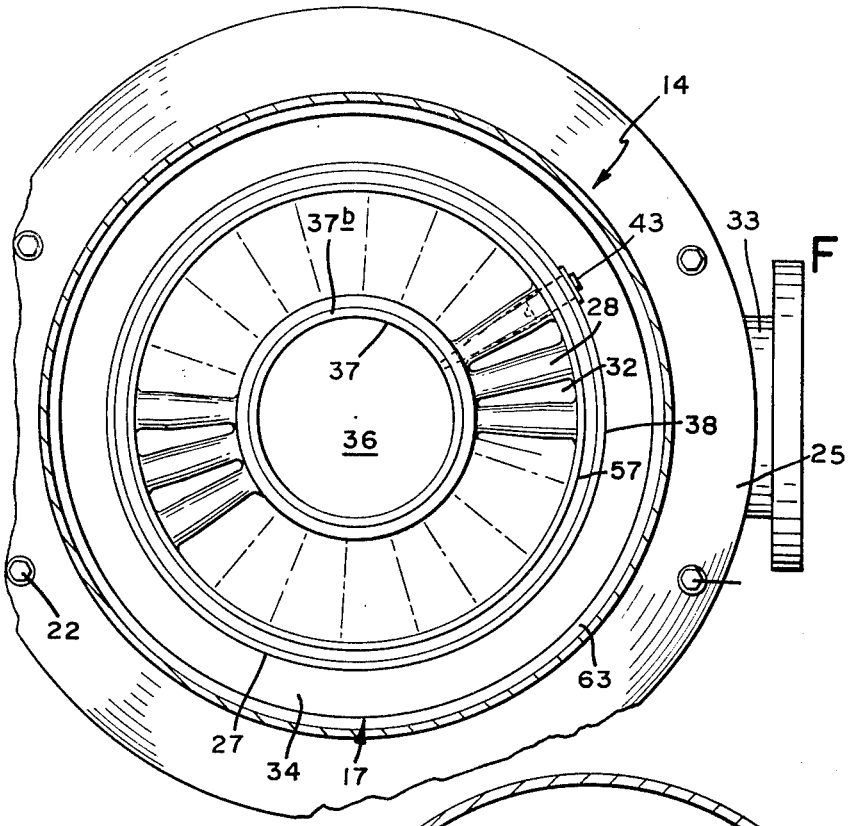
FIG. 3 is a sectional view taken on the line 3—3 of FIG. 2.
Figure 4:
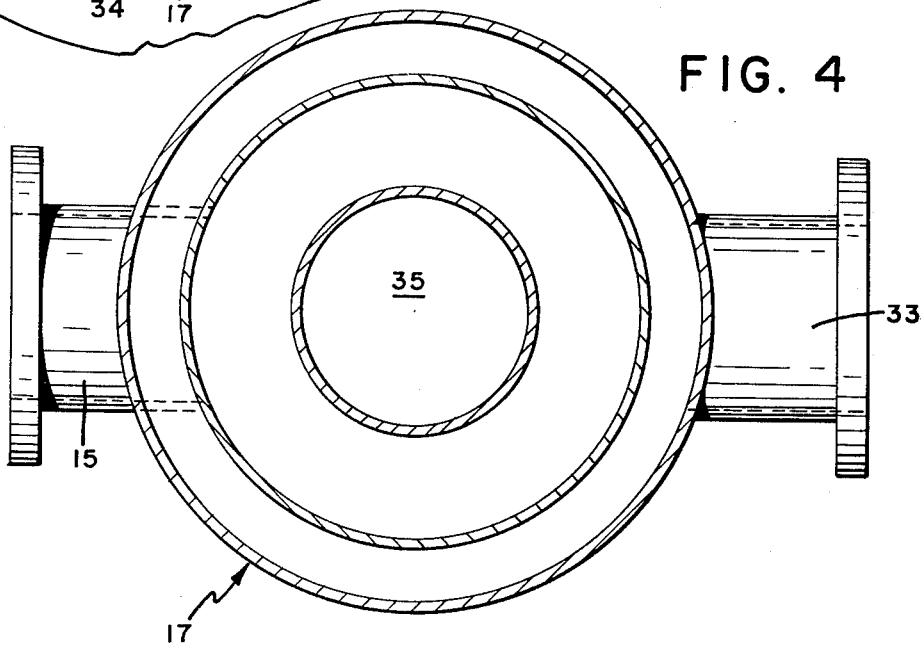
FIG. 4 is a sectional view taken on the line 4—4 of FIG. 2.

Referring now to the drawings and more particularly to FIGS. 1 to 3, wherein one embodiment of the present invention is clearly illustrated, a multiple hydrocyclone device is generally indicated by the reference numeral 14. Device 14 includes a cylindrical steel housing 15, a cover 16 for housing 15, and a base assembly 17 upon which housing 15 is mounted. Circular flanges 19 are provided about the periphery of cover 16 (FIG. 2) and housing 15 to which are secured interconnecting circular clamp members 21 by means of threaded fastening members 23.

In a like manner similar circular flanges 24 (FIG. 2) are provided on the upper periphery of base assembly 17 and the lower portion of housing 15 to which other clamp members 21 are secured and held in place by additional fastening member 23. A supporting base for device 14 comprises an inverted plate shaped member 25 secured to base assembly 17 and which member 25 is adapted to be secured to a support such as floor 26 by bolts 22.

A plurality of layers of cyclone clusters or discs 27 (FIGS. 1 and 2) each containing a plurality of individual cyclone bodies 28 are disposed in stacked relationship within housing 15. A feed inlet 30 is provided in base assembly 17 for introducing a solid containing liquid suspension into housing 15 through intermediate internal circular chamber 32 while a fines discharge outlet 33 is located in base assembly 17 to receive the fines discharge from the outer cylindrical chamber 34 arranged intermediate the outer periphery of cyclone clusters 27 and the inner wall of housing 15. A central discharge outlet 35 is provided in base assembly 17 for receiving the underflow fractions from the central chamber 36 in cyclone clusters 27.

Figure 5:
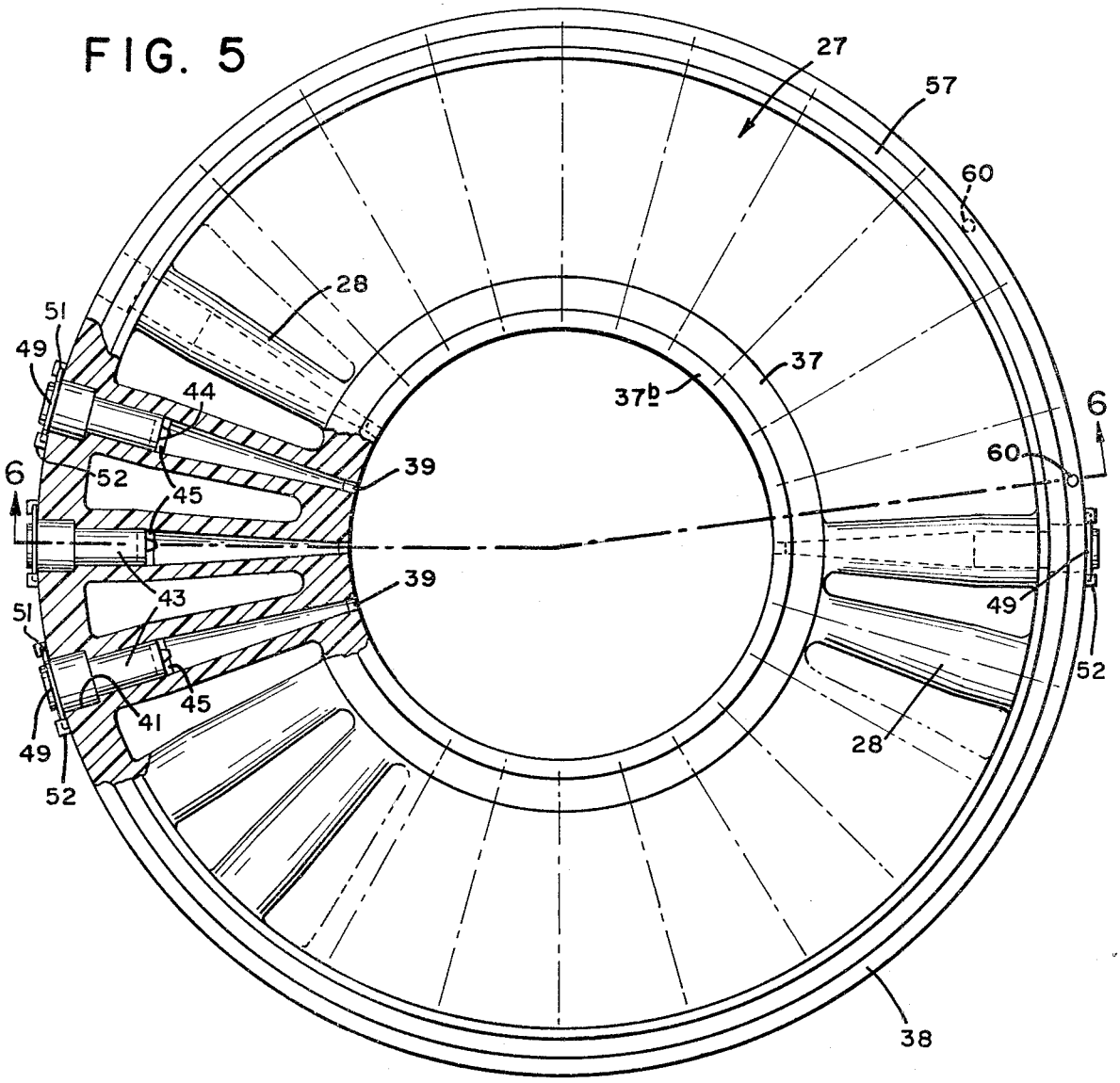
FIG. 5 is a plan view of one hydrocyclone disc with portions broken away to show the interior thereof.
Figure 6:
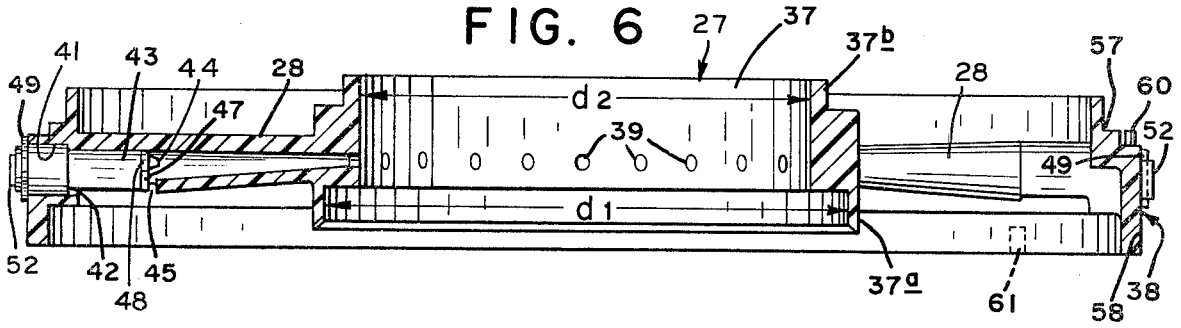
FIG. 6 is a sectional view taken on the line 6—6 of FIG. 5.

Each cyclone cluster or disc 27, as shown with respect to one cyclone cluster 27 in FIGS. 5–6, comprises a premolded disc formed from a suitable plastic material such as nylon. Each disc 27 includes a central hub portion 37 and an outer peripheral rim 38. Cyclone bodies 28 are integrally molded in disc 27 and extend radially in spoke-like manner from hub 37 to rim 38. Cyclone bodies 28 are of a generally cylindrical configuration and have an elongated conical part terminating at an apex opening 39 in hub 37. The opposite or base end of each cyclone body 28 terminates in an enlarged opening 41 in rim 38 adjacent a slot 42 (FIGS. 8 and 12) formed in the bottom of the cyclone body 27.

Figure 8:
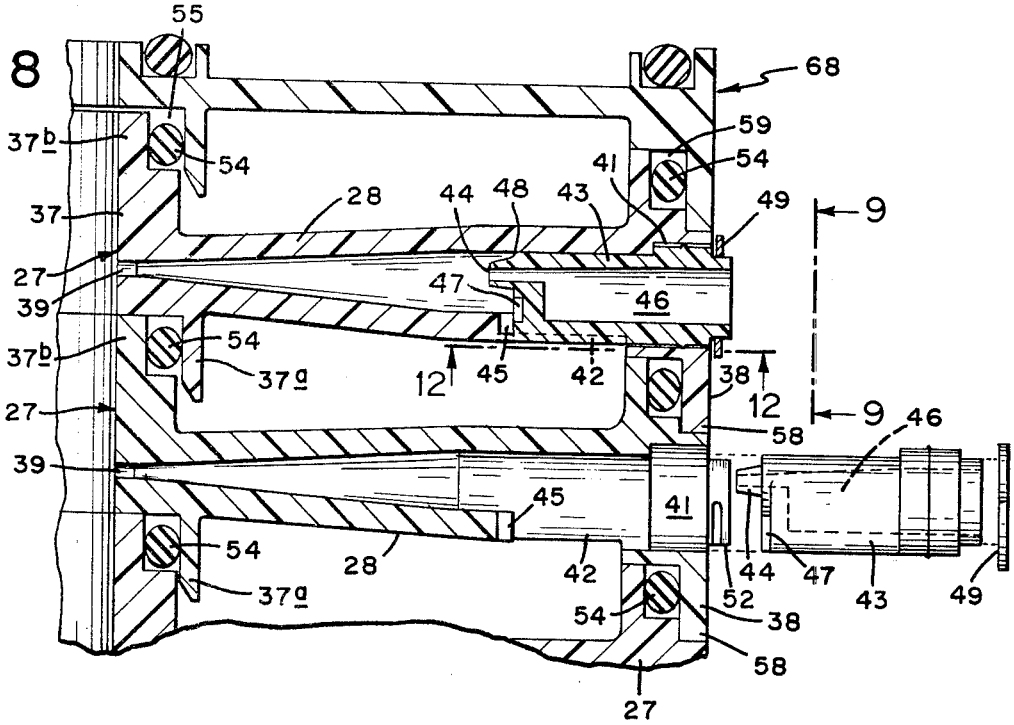
FIG. 8 is an enlarged sectional view of the radial portions of several stacked cyclone discs showing details of the structure thereof.
Figure 9:
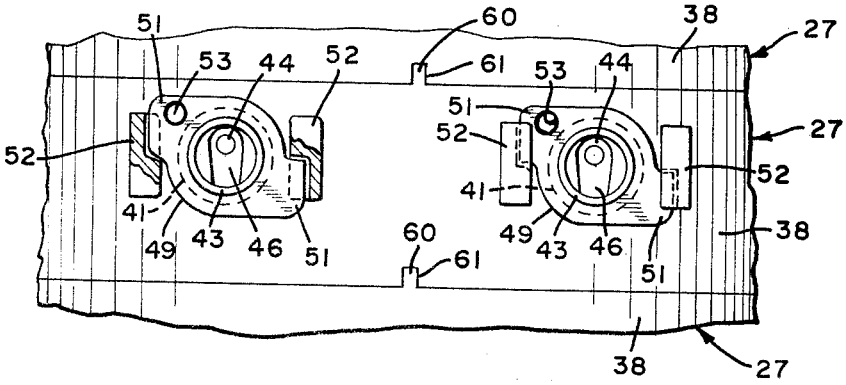
FIG. 9 is an end view as seen from the line 9—9 of FIG. 8 showing the means for locking the vortex finders in position.
Figure 12:
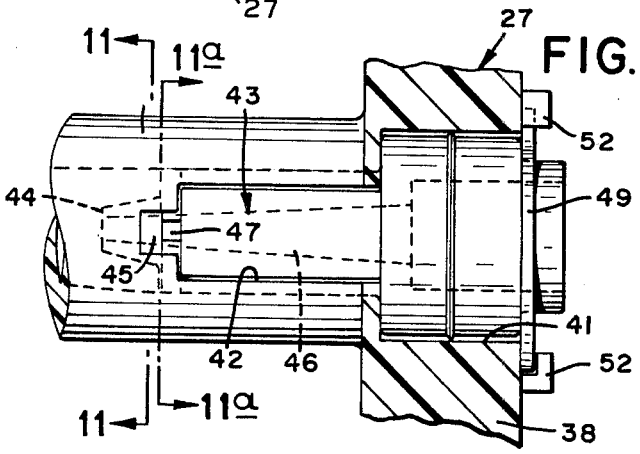
FIG. 12 is a sectional view taken on the line 12—12 of FIG. 8.
Figure 11A:
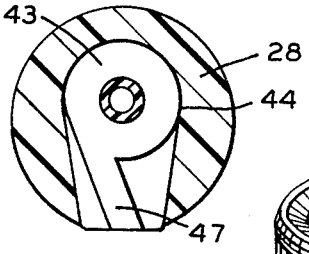
FIG. 11*a* is a sectional view taken on the line 11*a*—11*a* of FIG. 12.

Vortex finders comprising removable premolded plastic plug members 43 are mounted in each of said enlarged opening 41 in cyclone bodies 28. As seen in FIGS. 8, 9 and 12 each plug includes a leading tip portion 44 extending into the cylindrical part of the cyclone body 28 adjacent a tangential feed inlet 45 formed therein. An internal conduit 46 in plug 43 extends from tip 44 to outer or overflow chamber 34. The bottom of each vortex finder 43 is seated in slot 42 in body 28 with the leading edge of plug 43 formed with a diagonal boss 47 extending in the same plane from a cylindrical pilot extension 48 formed on the front surface of plug 43 beneath tip 44. Boss 47 projects partially into the inlet feed opening 45 to complete and retain the configuration thereof while cylindrical extension 48 extends into body 28 to locate plug 43 and prevent downward movement thereof.

Vortex finders 43 are secured to body 28 by means of locking plates 49 (FIGS. 8 and 9). Each plate 49 has a central opening 50 fitted over the protruding end portion of plug 43 with opposite ends 51 of plate 49 located in notched portions formed in protrusions 52 formed on the outer surface of rim 38. Vortex finders 43 are removable from body 28 and disc 27 by inserting a wrench end in opening 53 and rotating plate 49 clockwise as viewed from FIG. 9 to clear ends 51 of protrusions 52 and then withdrawing the vortex finder 45 from opening 41 in body 28.

Internesting means (FIG. 6) are provided on each cyclone disc 27 for positioning discs 27 one upon the other. To this end the bottom peripheral flange 37*a* of hub 37 is provided with a diameter designated "$d^1$" of greater length than the diameter designated "$d^2$" of the top peripheral flange 37*b* of hub 37. In this manner one disc 27 can be seated upon the top of the subadjacent disc in the stack. A sealing O-ring 54 is provided in the circular conduit 55 (FIG. 8) formed by the nested hubs 37 of adjacent discs 27. In a similar manner the upper portion of outer peripheral rim 38 of each disc 27 is provided with an inwardly stepped flange 57 upon which is seated the lower peripheral portion 58 of the rim 38 next highest disc 27 in the stack. A sealing O-ring 54 is also provided in the circular conduit 59 between stepped flange 57 and rim 58 of the nested discs to complete the sealing of the intermediate feed chamber 32 from the overflow and underflow chambers 34 and 36 respectively. In order to prevent rotation of the discs 27 one to the other bosses 60 (FIG. 9) are provided on stepped flange 57 of each rim 38 to be located in positioning notches 61 in the lower rim portion 58 of rim 38 of the next highest disc in the assembly.

Figure 7:
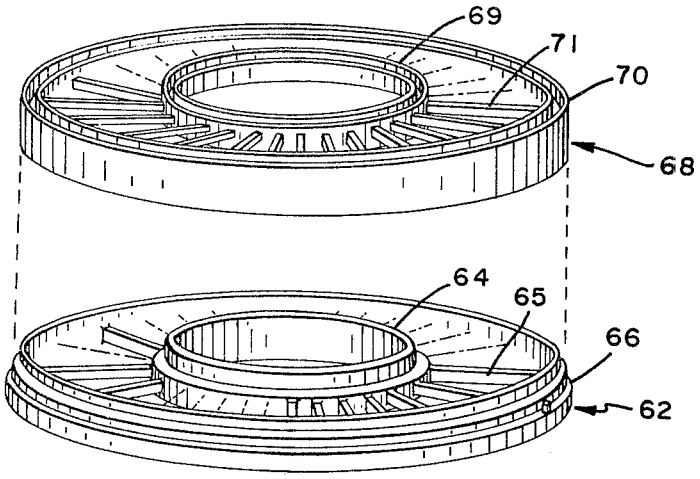
FIG. 7 is a perspective view of the upper and lower plates of the cyclone arrangement.

The stacked discs 27 are seated upon a molded bottom plate 62 (FIGS. 2 and 7) which is located on the upper wall surface 63 of base assembly 17. Bottom plate 62 is provided with a hub 64 open to underflow chamber 36 and upon which hub 64 is seated the lower portion of the hub 37 of the lowermost disc 27 in the disc assembly (FIG. 2). The rim 38 of the latter lowermost cyclone disc 27 is seated on rim 66 of bottom plate 62 which is interconnected to hub 64 by ribs 65. Appropriate sealing O-rings 54 are provided at hub 64 and rim 63 to insure that the spaced chambers 32, 34 and 36 are sealed one from the other.

An aligning top plate 68 (FIGS. 7 and 10) is provided at the top of the cyclone clusters and is seated upon the uppermost disc 27 thereof. Top plate 68 is similar in configuration to discs 27 and includes a hub 69 and outer rim 70 interconnected by ribs 71. Hub 69 and rim 70 are seated in nested position on hub 37 and rim 38 of the top cyclone disc 27 and appropriate O-rings 54 are provided about hub 69 and rim 70 to seal the chambers 32, 34 and 36 one from the other.

Figure 13:
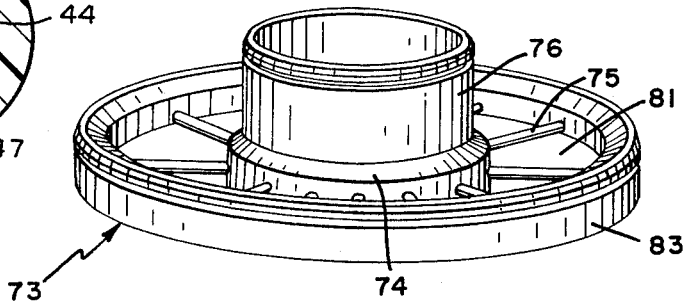
FIG. 13 is a perspective view of the thrust plate of FIG. 10.

As mentioned it is a feature of this invention to provide novel means for maintaining the assembly of stacked cyclone discs 27 in position and yet permit limited relative vertical movement of the stacked discs 27 one to the other during the operation of device 14 without breaking the sealed relationship. This limited vertical movement between adjacent discs 27 may occur for example either due to predetermined thermal moisture expansion factors of the plastic composition of a disc 27. To this end thrust plate means are provided at the uppermost part of housing 15 and include a cylindrical metal plate member 73 (FIGS. 2, 10 and 13) seated on molded top plate 68 of the cyclone assembly. The hub portion 74 of thrust plate 73 is imperforate and includes a circular upright cylindrical flange portion 76 having wall portions extending in telescopic relationship into a cylindrical locating section 78 depending from cover 16 of device 14 to form a housing 79 for a spiral compression spring 80. The outer periphery of the undersurface of cover 16 is provided with a depending wall portion 82 against which is located the peripheral surface of rim 83 of thrust plate 73 which is interconnected to hub 74 by ribs 75. O-rings 54 also are provided about the periphery of rim 83 to seal cover 16 from overflow chamber 34 and about cylindrical flange 76 of hub 74 to seal housing 79 from feed chamber 32.

A rod 85 is secured to thrust plate 73 and is provided with a threaded portion which extends outwardly of cover 16. An adjusting nut 86 is threaded about rod 85 and is disposed in mounting member 88 atop cover 16. A removable protective cap 89 is disposed over mounting member 88. Spring member 80 is located about rod 85 within housing 79 and has its lower end abutting against plate 73 and the opposite end abutting against the under surface of cover 16. As will be understood the adjustment of nut 86 compresses or releases tension of spring 80 to obtain the selected pressure necessary to maintain discs 27 in stacked assembly.

In one operative device made according to the present invention as disclosed in FIGS. 1 to 10, ten discs 27 are utilized with each disc 27 provided with twenty-four cyclone bodies 28 resulting in a device having 240 operative cyclone units. In operation of device 14 a solids containing liquid suspension is fed under pressure to discs 27 through inlet feed opening 30 in base assembly 17 and thence upwardly into housing 15 to intermediate chamber 32 with the liquid suspension entering cyclone bodies 28 through tangential feed openings 45 therein. In a known manner the rotational force of the feed entering bodies 28 is such that the lighter or overflow fines fraction in the suspension exits bodies 28 through vortex finders 43 to outer overflow chamber 34 and outwardly of device 14 through fines discharge outlet 33. Simultaneously the heavier fraction or underflow exits through apex openings 39 of the cyclone bodies 28 to central chamber 36 and outwardly of housing 15 through central outlet 35 in a usual manner.

In operation of device 14 thrust plate 73 utilizes the force available from the feed pressure of the liquids suspension to maintain stacked discs 27 in assembled relationship by providing an axial force at the top of the cyclone stack against the high feed pressure. The forces acting downward upon thrust plate 73 include the initial force of spring 80 and the effective force resulting from the feed pressure. Openings 81 provided between ribs 75 in thrust plate 73 allow the feed fluid to enter the area of cover 16 and exert additional pressure upon the top of plate 73. The high feed pressure acts over a large enough area on the top of thrust plate 73 to exceed the force developed by the pressures on the bottom of plate 73 and thus yields a net downward thrust. Additional forces acting upward in device 14 include the underflow and overflow fluid pressures from chamber 34 and 36 in addition to the feed pressure of the fluid in chamber 32. The present arrangement permits control of these factors while at the same time allowing for slight expansion or movement between adjacent discs 27 as will occur from time to time in accordance with temperature changes, internal pressures and like factors but without interfering with the sealing integrity between the chambers. In operation of device 14 nut 86 and its support 88 on rod 85 are free to rise with thrust plate 73 during any such expansion or movement of discs 27.

It is to be further noted that in assembled stacked relationship of discs 27 the axial force exerted thereon by thrust plate 73 causes compression of those sealing O-rings 54 located in conduits 55 and 59 between adjacent discs 27. The vertical sidewalls of conduits 55 and 59 are dimensioned so as to engage the adjacent surfaces of seals 54 and effect a continuous peripheral radial sealing force in the direction indicated by the arrow A in FIG. 10.

Figure 10:
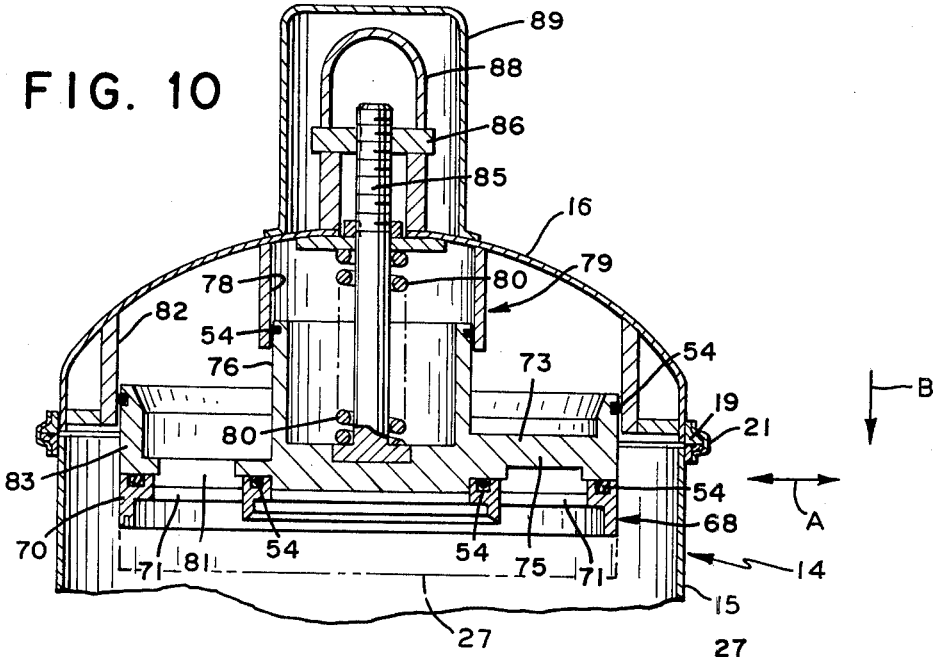
FIG. 10 is an enlarged fragmentary cross-sectional view of the upper portion of the device of FIG. 1 showing details of the thrust plate assembly.
Figure 11:
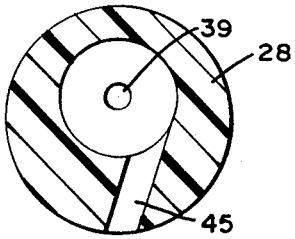
FIG. 11 is a sectional view taken on the line 11—11 of FIG. 12.

In addition at the top and bottom of housing 15 an axial force is exerted on O-rings 54 between thrust plate 73 and top plate 68 and on the O-rings 54 between bottom plate 62 and top wall 63 of base 17 to effect axial seals in the direction indicated by the arrow B (FIGS. 2 and 10). As a result of this sealing arrangement the leak proof integrity of concentric chambers 32, 34 and 36 is maintained in an efficient and economical manner.

Figure 14:
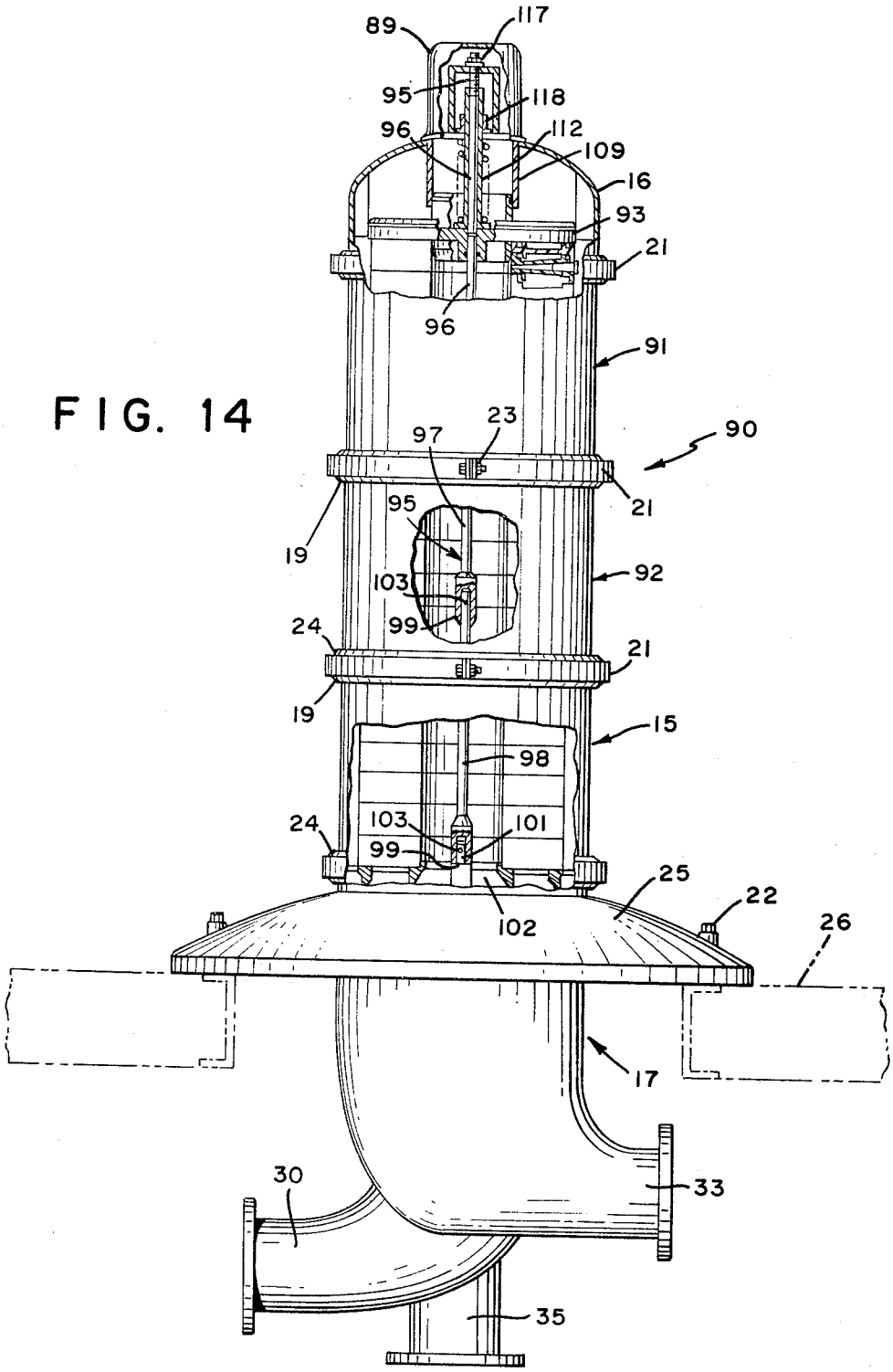
FIG. 14 is an elevational view of another embodiment of the present invention with portions of the housing of the device broken away to show the interior thereof.
Figure 15:
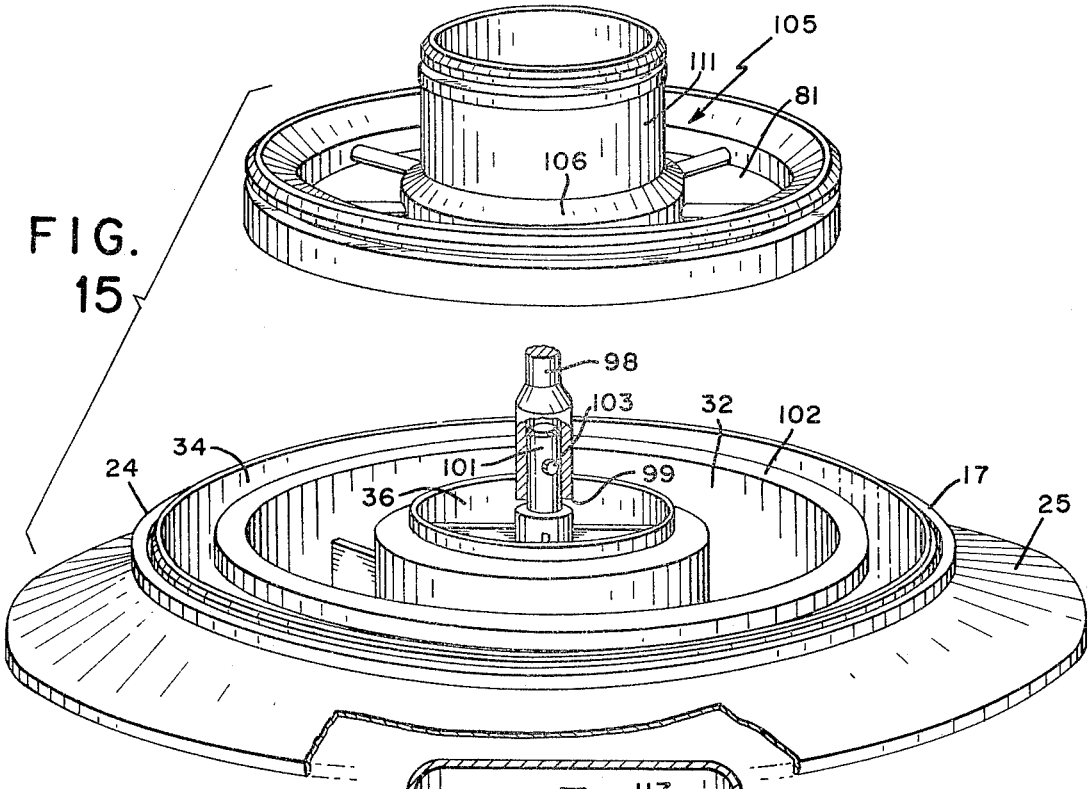
FIG. 15 is a perspective view of the thrust plate and base plate of the cyclone disc assembly of FIG. 14.
Figure 16:
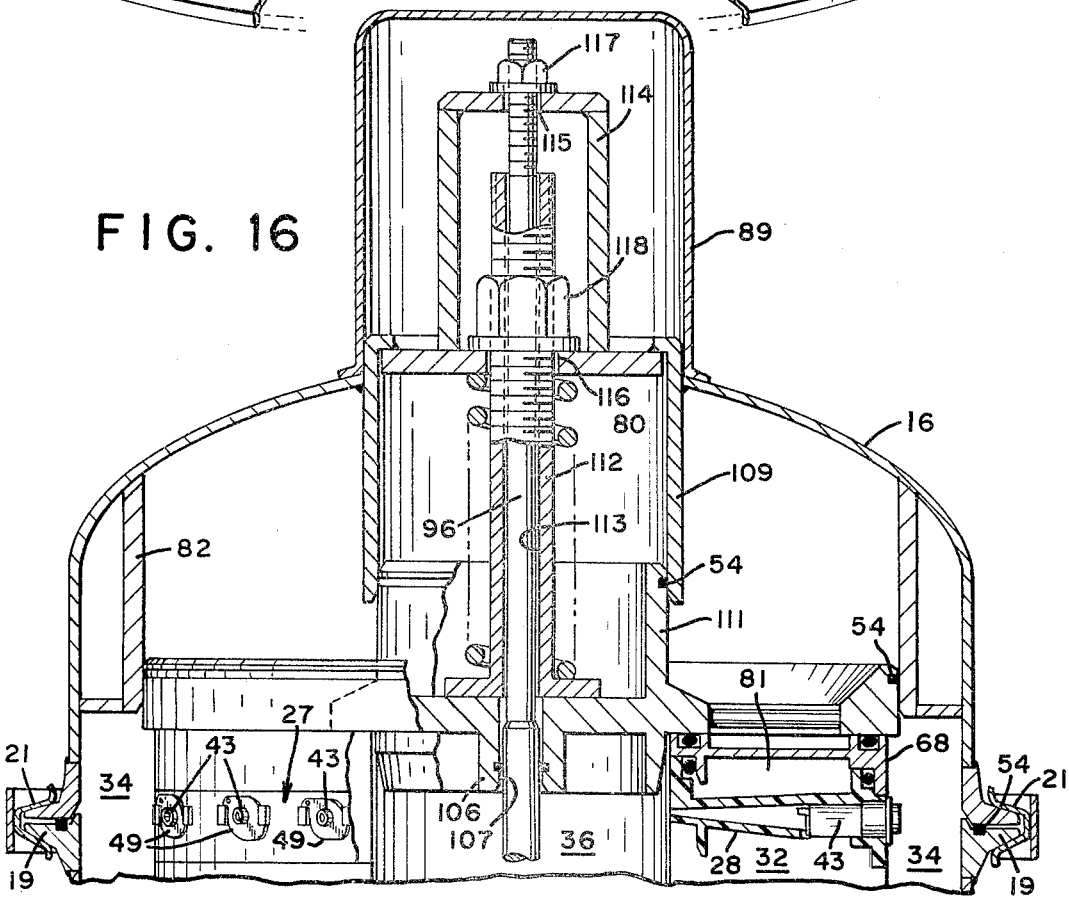
FIG. 16 is an enlarged view of the upper portion of the device of FIG. 14 showing details of the thrust plate assembly.

In FIGS. 14 to 16 there is shown another embodiment of the present invention wherein modifications of the thrust plate means and housing assembly are shown and in which figures corresponding reference numerals have been applied to like elements of structure previously described.

As mentioned it is a further feature of this invention to provide a multiple hydrocyclone apparatus having modular capabilities wherein additional cyclone discs 27 can be added or removed from the assembly to increase or reduce the operational capacity thereof. To this end a multiple hydrocyclone device 90 (FIG. 14) is provided with additional housing sections 91 and 92 mounted upon housing section 15. Housing sections 91 and 92 have mated upper and lower flanges 19–24 secured one to the other by suitable clamp members 21 and fastening members 23. In this manner 30 additional cyclone cluster discs 27 are added to the cyclone assembly for a total of thirty discs 27 or 720 total cyclone bodies 28 providing a machine of increased separation capabilities. Housing sections 91–92 and cyclone clusters 27 therein may be easily added or removed or individual clusters 27 replaced in accordance with the particular needs of the user.

In device 90 a drawbolt 95 is included for additional means to maintain cyclone discs 27 in stacked relationship. Drawbolt 95 is comprised of three segments 96, 97 and 98. Segment 98 has an open end 99 fitted over post 101 of bottom plate 102 and is releasably secured thereto by a dowel pin 103. In a like manner segment 97 is releasably connected to segment 96 and segment 98 is releasably connected to segment 97.

Thrust plate means for device 90 include a plate member 105 similar to thrust plate member 73 except that hub 106 thereof is reinforced to permit drawbolt segment 96 to extend through an opening 107 therein. The housing for compression spring 80 includes a cylindrical housing 109 secured to the walls of cover 16 as by welding at opening 110 therein. Circular flange portion 111 of hub 106 is arranged for slidable movement against the walls of housing 109. A thrust plate rod 112 is mounted atop thrust plate 105 and is provided with a longitudinally extending conduit 113 through which extends drawbolt section 96. A support 114 for drawbolt 95 is secured to the peripheral flanges of cylindrical housing 109 with drawbolt section 96 and rod 112 extending through openings 115 and 116 therein with drawbolt 95 locked in position by nut 117.

Compression spring 80 is disposed about rod 112 and has one end engaging the bottom of support 114 and the opposite end abutting plate 105. An adjustable locking nut 118 is provided about the threaded end of rod 112 for precompressing spring 80 with rod 112 and thrust plate 105 free to move upwardly on drawbolt 95 during operation of device 40 in accordance with the movement of cyclone discs 27 as previously described.

It is apparent from the foregoing description that the novel multiple hydrocyclone assembly has many advantages in use. One advantage among others is that cyclone discs are interchangeable and may be readily replaced or added to an assembly. Another advantage is that the novel internesting of cyclone discs provides for a reduction in parts in a multicyclone assembly resulting both in a standardization of parts and reduction in overall costs. Another advantage is that the thrust plate provides an efficient means for maintaining the internested but otherwise unconnected discs in assembled relationship without the need for individual connecting mechanisms for each layer of cyclones or individual cyclones while maintaining the sealed integrity between the various internal fluid chambers formed by the discs.

Although two embodiments of the present invention has been illustrated and described in detail, it is to be expressly understood that the present invention is not limited thereto. Various changes can be made in the design and arrangement of parts without departing from the spirit and scope of the invention as the same will now be understood by those skilled in the art.

What is claimed is:

1. A multihydrocyclone device comprising:

a. an enclosed cylindrical housing, b. a plurality of cyclone cluster discs stacked concentrically one upon the other within said housing in internested vertical relationship, c. each of said cyclone discs comprising a premolded circular support member having an inner hub and an outer rim portion interconnected by a plurality of integrally formed radially extending spaced cyclone bodies, d. said outer rim portions of said stacked cyclone discs spaced from the walls of said housing to provide an outer discharge chamber in said housing, e. an inner discharge chamber spaced from said outer discharge chamber and formed by the nested hub portions of said cyclone discs, f. a feed inlet chamber provided intermediate said discharge chambers between said cyclone bodies, g. spaced underflow and overflow openings in each of said cyclone bodies each opening to one of said discharge chambers, h. positioning means provided on said discs for aligning said discs in stacked concentric relationship one upon the other, and i. releasable means provided at the top of said cluster stack for maintaining said discs in said stacked concentric relationship and including a thrust plate mounted on top of said stack of cyclone discs, spring means engaging said thrust plate and means for adjusting the tension of said spring means.

2. The device of claim 1 wherein said discs are premolded from a plastic material.

3. The device of claim 2 wherein said spring means comprise a compression spring and wherein means are provided for adjusting the tension of said compression spring to permit limited vertical movement of said discs one to the other in accordance with predetermined thermal moisture expansion factors of the plastic material from which said discs are molded.

4. A multihydrocyclone device comprising:

a. an enclosed cylindrical housing, a plurality of separable circular cyclone cluster discs stacked concentrically one upon the other within said housing in internested vertical relationship, b. each of said cyclone discs comprising a premolded plastic member having an inner hub and an outer rim portion interconnected by a plurality of integrally formed radially extending spaced cyclone bodies, c. said outer rim portions of said stacked cyclone discs spaced from the walls of said housing to provide an outer discharge chamber in said housing, d. an inner discharge chamber spaced from said outer discharge chamber and formed by the internested hub portions of said cyclone discs, e. a feed inlet chamber provided intermediate and concentrically of said discharge chambers for receiving a feed influent for dispersal between said cyclone bodies, f. spaced underflow and overflow openings provided in each of said cyclone bodies opening to said discharge chambers, g. removable vortex finders in said cyclone bodies each comprising a plug member having an internal conduit inserted in the overflow opening of each cyclone body and open at opposite ends respectively to said cyclone body and said overflow chamber, h. positioning means provided on said discs for aligning said discs in stacked concentric relationship one upon the other, and for receiving compressible sealing members to seal said inlet chamber and said spaced discharge chambers one from the other, and i. ready releasable means provided at the top of said stacked cyclone cluster discs to radially compress said sealing members and for maintaining said discs in said stacked concentric relationship while allowing for vertical movement of said separable discs relative to each other without breaking said seals between said chambers.

5. The device of claim 4 wherein said vortex finders comprise plug members formed with a pilot portion to locate said plug member in said cyclone body to prevent downward movement of said member.

6. The device of claim 5 wherein a tangential feed inlet channel is formed in each of said cyclone bodies and where diagonal bosses extend from said pilot portion of said plug in co-planar relationship therewith adapted for partial projection into said feed inlet channels to complete the configuration of said feed inlet.

7. The device of claim 5 wherein clamp members are provided for maintaining said vortex finders in position in said cyclone bodies and include a plate member mounted over one end of a said vortex finder and means formed in the outer rim of said cyclone discs for detenting the spaced ends of said clamp members.

8. A multihydrocyclone device comprising:

a. an enclosed cylindrical housing, a plurality of individual and separate circular cyclone cluster discs stacked within said housing, b. each of said cyclone discs comprising a premolded plastic member having an inner hub and an outer rim portion interconnected by a plurality of integrally formed radially extending spaced cyclone bodies, c. said outer rim portions of said stacked cyclone discs spaced from the inner wall surfaces of said housing to provide an outer discharge chamber in said housing, d. an inner discharge chamber spaced from said outer discharge chamber and formed by the internested hub portions of said cyclone discs, e. a feed inlet chamber provided intermediate said discharge chambers between said cyclone bodies, f. spaced underflow and overflow openings in each of said cyclone bodies each opening to one of said discharge chambers, g. removable vortex finders each comprising a plug member inserted in the overflow opening of each cyclone body, h. positioning means provided on said hub and rim portions including flange portions adapted for internesting said discs one upon the other in aligned stacked concentric relationship, and i. a ready releasable thrust plate provided at the top of said cluster stack exerting an axial force on said discs for maintaining said discs in said stacked concentric relationship.

9. The device of claim 8 wherein said internested flanges of said hub and rim portions include space wall portions providing peripheral conduits about said rim and said hub, sealing rings disposed within said conduits, said wall portions dimensioned to engage said sealing rings to effect a radial compression of said sealing rings in internested relationship of said discs.

10. The device of claim 8 wherein said thrust plate member comprises a cylindrical metallic member and wherein sealing rings are provided between said plate and cyclone discs.

11. The device of claim 10 wherein compression spring means are provided to engage said thrust plate to establish a preselected axial force therein.

12. The device of claim 11 wherein adjustable nut means are provided externally of said housing for adjusting the tension of said compression spring means.

13. A multihydrocyclone device comprising:

a. an enclosed cylindrical housing, b. a plurality of cyclone cluster discs stacked concentrically one upon the other within said housing in internested vertical relationship, c. each of said cyclone discs comprising a premolded circular support member having an inner hub and an outer rim portion interconnected by a plurality of integrally formed radially extending spaced cyclone bodies, d. said outer rim portions of said stacked cyclone discs spaced from the walls of said housing to provide an outer discharge chamber in said housing, e. an inner discharge chamber spaced from said outer discharge chamber and formed by the nested hub portions of said cyclone discs, f. a feed inlet chamber provided intermediate said discharge chambers between said cyclone bodies, g. spaced underflow and overflow openings in each of said cyclone bodies each opening to one of said discharge chambers, h. positioning means provided on said discs for aligning said discs in stacked concentric relationship one upon the other, said positioning means including flange portions on the hub and outer rim portions, each of said cyclone discs formed of a selected configurated to internest with the hub and rim portions of the subjacent and superjacent discs of said stack, i. bosses formed on the outer rim of said disc members for cooperative engagement in openings formed in the outer rim of the next adjacent disc in said cyclone stack to prevent rotative movement of said nested discs, j. said internesting flange portions forming spaced cylindrical conduits and compressible sealing members disposed within said conduits to seal said inlet chamber and said spaced discharge chambers one from the other, k. releasable means provided at the top of said cluster stack to radially compress said sealing members and further adapted to maintain said discs in said stacked sealed concentric relationship while allowing for slight vertical movement of one disc relative to the other.

* * * * *